US010939523B2

(12) United States Patent
Hanslip

(10) Patent No.: US 10,939,523 B2
(45) **Date of Patent: *Mar. 2, 2021**

(54) EFFICIENT DYNAMIC LIGHT MIXING FOR COMPACT LINEAR LED ARRAYS

(71) Applicant: Aion LED, Inc., San Francisco, CA (US)

(72) Inventor: Ryan Hanslip, San Francisco, CA (US)

(73) Assignee: Aion LED, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/537,285

(22) Filed: Aug. 9, 2019

(65) Prior Publication Data

US 2019/0364639 A1 Nov. 28, 2019

Related U.S. Application Data

(63) Continuation of application No. 16/160,536, filed on Oct. 15, 2018, now Pat. No. 10,383,189, which is a continuation of application No. 15/716,244, filed on Sep. 26, 2017, now Pat. No. 10,111,294.

(60) Provisional application No. 62/524,380, filed on Jun. 23, 2017, provisional application No. 62/483,883, filed on Apr. 10, 2017, provisional application No. 62/400,016, filed on Sep. 26, 2016.

(51) Int. Cl.

| | |
|---|---|
| ***H05B 45/10*** | (2020.01) |
| ***H05B 45/20*** | (2020.01) |
| ***H05B 47/19*** | (2020.01) |

(52) U.S. Cl.

CPC ..... *H05B 45/20* (2020.01); *H05B 45/10* (2020.01); *H05B 47/19* (2020.01)

(58) Field of Classification Search

None

See application file for complete search history.

(56) References Cited

U.S. PATENT DOCUMENTS

| | | | |
|---|---|---|---|
| 6,013,988 | A | 1/2000 | Bucks |
| 6,016,038 | A | 1/2000 | Mueller |
| 6,094,014 | A | 7/2000 | Bucks |
| 6,150,774 | A | 11/2000 | Mueller |
| 6,234,645 | B1 | 5/2001 | Borner |
| 6,250,774 | B1 | 6/2001 | Begemann |
| 6,513,949 | B1 | 2/2003 | Marshall |

(Continued)

*Primary Examiner* — Dedei K Hammond

(74) *Attorney, Agent, or Firm* — Critical Path IP Law, LLC

(57) ABSTRACT

Systems, software, and methods are provided for efficient, dynamic lighting control. In an embodiment, a two-channel LED lighting system is dynamically controlled to emulate dimming of an incandescent fixture. In an example, a lighting fixture may include red, green, blue, and white emitting LED modules. The lighting fixture may be controlled such that it produces generally white light from about 2150K candle light color to 5500K daylight white color with only 4 LEDs. Furthermore, the white LED may be controlled such that the white LED CRI is approximately 95 to ensure optimal results when mixed with red and green. In another embodiment, a dynamic two-channel LED lighting system is controlled to emulate dimming of an incandescent fixture. Specific dimming protocol can allow for efficient dimming which helps minimize the height of a linear light fixture and maintain diffusion with multiple colored point sources at minimal pitch.

20 Claims, 6 Drawing Sheets

(56) References Cited

U.S. PATENT DOCUMENTS

| | | | | |
|---|---|---|---|---|
| 6,577,512 | B2 | 6/2003 | Tripathi | |
| 6,586,890 | B2 | 7/2003 | Min | |
| 6,692,136 | B2 | 2/2004 | Marshall | |
| 6,788,011 | B2 | 9/2004 | Mueller | |
| 7,014,336 | B1 | 3/2006 | Ducharme | |
| 7,038,399 | B2 | 5/2006 | Lys | |
| 7,202,608 | B2 | 4/2007 | Robinson | |
| 7,255,457 | B2 | 8/2007 | Ducharme | |
| 7,255,458 | B2 | 8/2007 | Ashdown | |
| 7,274,160 | B2 | 9/2007 | Mueller | |
| 7,352,138 | B2 | 4/2008 | Lys | |
| 7,358,681 | B2 | 4/2008 | Robinson | |
| 7,802,902 | B2 | 9/2010 | Moss | |
| 7,828,465 | B2 | 11/2010 | Roberge | |
| 8,456,109 | B1 * | 6/2013 | Wray | H05B 33/0824 315/307 |
| 9,249,965 | B2 | 2/2016 | Weeme | |
| 10,278,251 | B1 | 4/2019 | Fledderman | |
| 2012/0242247 | A1 * | 9/2012 | Hartmann | H05B 33/0863 315/294 |
| 2013/0063035 | A1 * | 3/2013 | Baddela | H05B 33/086 315/192 |
| 2014/0035472 | A1 | 2/2014 | Raj | |
| 2016/0183351 | A1 * | 6/2016 | Snyder | H05B 37/02 315/152 |
| 2016/0186968 | A1 | 6/2016 | Edwards | |
| 2016/0254416 | A1 | 9/2016 | Cheng | |
| 2017/0318643 | A1 | 11/2017 | Qiu | |

* cited by examiner

EFFICIENT DYNAMIC LIGHT MIXING FOR COMPACT LINEAR LED ARRAYS

This application is a continuation of U.S. patent application Ser. No. 16/160,536, filed Oct. 15, 2018, which is a continuation of U.S. patent application Ser. No. 15/716,244, filed Sep. 26, 2017, now U.S. Pat. No. 10,111,294 issued Oct. 23, 2018, which claims the benefit of U.S. Provisional Patent Application Ser. No. 62/400,016, filed Sep. 26, 2016, U.S. Provisional Patent Application Ser. No. 62/483,883, filed Apr. 10, 2017, and U.S. Provisional Patent Application Ser. No. 62/524,380, filed Jun. 23, 2017, the entire disclosures which are incorporated by reference herein.

BACKGROUND

Many different individuals and companies have attempted to create devices that are capable of emulating white light or sunlight. Sunlight is a black body emitter. One device or technology used is light emitting diodes (LEDs).

LEDs may have many advantages over incandescent light sources including lower energy consumption, less heat, longer lifetime, improved physical robustness, smaller size, and faster switching. It may be very expensive and difficult to emulate white light or sun light with LEDs.

Problems with LED lighting include pixelation, where the individual LED lights produce non-uniform light such that you can tell there are individual light sources instead of a continuous source. In order to minimize and decrease the size of a diffused linear LED lighting fixture, the lens or optic needs to be moved closer toward the LEDs and the space between each LED (pitch) needs to also be minimized. Without doing so, unsightly pixilation can occur, which is entirely unacceptable for direct-view installations.

The pixel pitch increases, exponentially, with the introduction of additional colored LEDs as the space between each color becomes the visible pitch that requires mitigation. The simplest way to create a diffused, warm-dimming type, architectural, dynamic lighting fixture is to utilize the fewest number of LED's per increment. The ultimate goal is to represent the visible light spectrum with specific and repeatable spectral values or useful warm-white color temperatures on the Kelvin scale; while following the visual aesthetics of the Planckian locus on the lower/warmer end. There has also been difficulty emulating incandescent lighting colors and dimming performance.

In physics and color science, the Planckian locus or black body curve is the path or locus that the color of an incandescent black body would take in a particular chromaticity space as the blackbody temperature changes. It goes from deep red at low temperatures through orange, yellowish white, white, and finally bluish white at very high temperatures.

Black body sources (approximately any filament bulb or sunlight—but not fluorescent lamps, in general) emit a smooth distribution of wavelengths across the visible spectrum, which means that our eyes and visual system can reliably distinguish colors of non-luminous objects. Subconsciously we adapt to differing bias in the illuminant color and manage to perceive consistent colors in the artifacts we handle every day (food, clothes, etc.)—despite wide variations in their absolute color.

Artificial sources of light, in particular discharge lamps (sodium, mercury, xenon), LEDs, and fluorescent lamps can have extremely spikey spectral distributions, and this means that their color rendering properties may typically be very poor (even if the overall perceived illuminant color is close to a blackbody color).

In professional lighting, a Color Rendering Index, CRI (sometimes written Ra: Red Average) is often quoted to indicate how accurately that light will portray colors relative to a blackbody source (the sun) at the same nominal color temperature. By definition, all blackbody sources have a CRI of 100. Fluorescent lamps typically have CRIs in the range 55-85, with 80-85 being classed by the manufacturers as 'good' or 'very good' color-rendering.

OVERVIEW

Systems, software, and methods are provided for variable, efficient, dynamic LED or other lighting control. In one example, a two-channel linear LED lighting system is dynamically controlled to emulate dimming of an incandescent fixture. In another example, a lighting fixture may include red, green, blue, and white linear LED modules. The lighting fixture may be dynamically controlled such that it produces specification grade, quality, white light from about 2150K candle light color to 5500K daylight white color with only 4 LEDs. Furthermore, the white LED may be controlled such that the white LED CRI is approximately 95 to ensure optimal results when mixed with red and green.

DESCRIPTION

Figure 1:
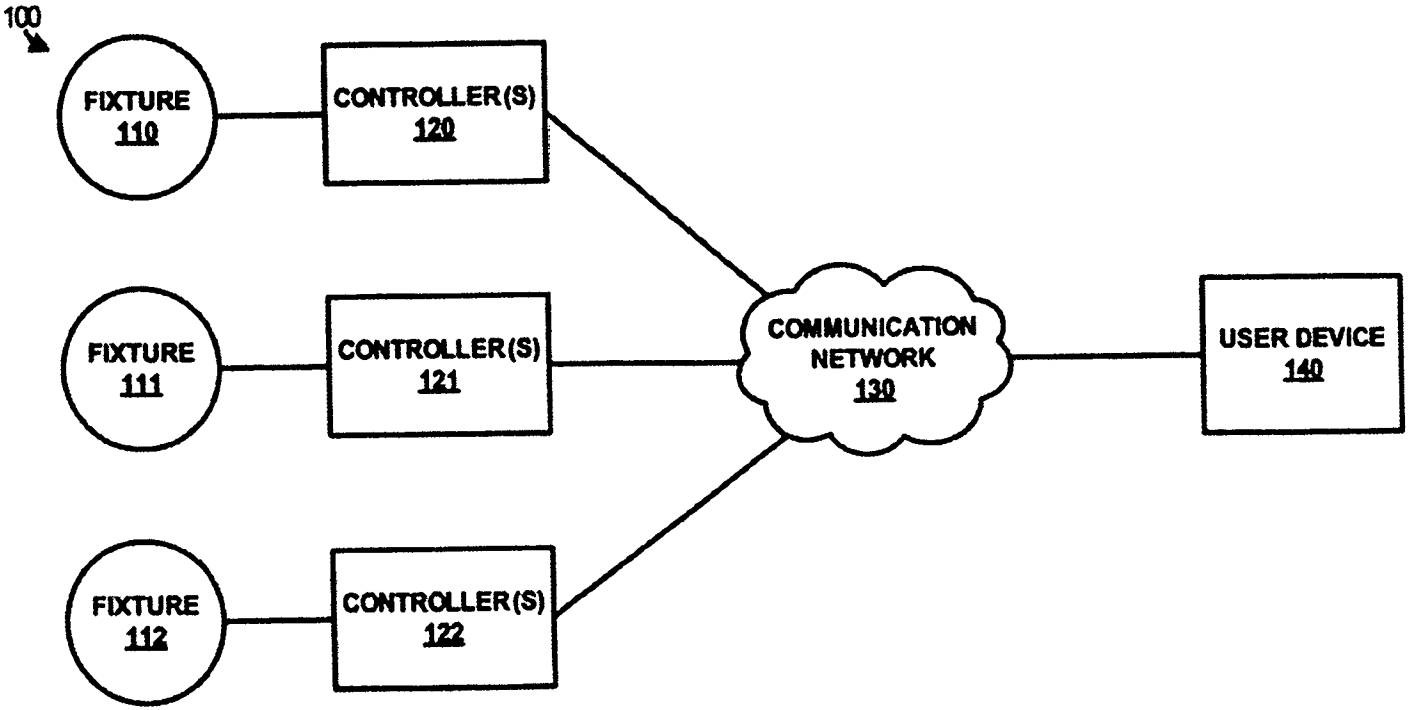
FIG. 1 illustrates a system according to one example.

Systems, software, and methods are provided for lighting control. In one embodiment, a two-channel LED lighting system is controlled to emulate the visual perception of dimming an incandescent fixture. In an example, a lighting fixture may include red, green, blue, and white emitting LED modules. The lighting fixture may be controlled such that it produces generally white light from about 2150 Kelvin Candle Light color to 5500K Daylight White color with only 4 LEDs. Furthermore, the white LED may be controlled such that the white LED CRI is approximately 95 to ensure optimal results when mixed with red, green and blue. In another embodiment, a two-channel LED lighting system is controlled to emulate dimming of an incandescent fixture. In the other embodiment, a four-channel LED lighting system is controlled to similarly emulate dimming of an incandescent fixture, however also can produce colored light.

A 2 channel or 2 LED dynamic lighting module system of the present disclosure allows for smooth "warm-dimming" effect created by two warm white LEDs in one fixture. The first LED module may be capable of outputting a generally warm white light. The other LED module may be capable of outputting a generally ultra-warm or warmer white light. This system was specifically to satisfy the need to efficiently emulate lighting performance aesthetics of older incandescent light bulbs (2700K) and can also be used for circadian rhythm lighting applications. When a modern LED dims, it does not change color and does dim to a warm glow like was seen with prior technology.

Other manufacturers may attempt to linearly cross-fade intensity between the warm and cool LEDs, but the effect is not smooth, does not look like dimming of an incandescent source, natural, or does not look natural. The disclosed solution includes dynamically controlling the 2 channel system to never let the total output (sum) percentage between the two LED modules exceed 100%.

Standard LED dimming may vary and will not mimic the visual aesthetics of an incandescent light. The present system allows for the warm dimming effect to occur with only two LEDs, which is imperative for smaller-profile, linear applications that required tight pitch (spacing between LEDs) for uniform diffusion, thereby reducing pixilation. In the disclosed system, the cool LED at max brightness begins to descend in intensity while the warm LED simultaneously increases intensity from zero. Rather than crossing over in the middle and trading, control includes that the warm LED stops at 50% and returns to zero. This is the basis of the invention and the characteristics of this "dim curve" or distribution of relative dim levels that is required for optimal results when:

1. The LEDs are arranged in the form of a linear array.
2. Small profile extruded fixture housings paired with diffuser and beam-shaping optics are employed.

The present system also may provide a large range of "warmer" colors using only 4 LED modules. Most current systems may use 5-6 LED modules to create the same effects. The red, green and blue are usually supplemented by a warm and a cool white.

The lighting fixtures may be controlled at least in part by a DMX-type controller paired with multiple power supplies (drivers). At the heart of the system herein is a DTM, or 'Dynamic Tuner Module'. The DTM is a network device that can communicate with lighting controls and fixtures via a network router. DTM may also links to an iOS or Android-type device over WI-FI or blue tooth, putting the power to configure, control and customize intensity, color and color temperature of white lighting usable at a user device, such as a smartphone.

A 4 channel dynamic color/RGBW source or module fixture may be used that includes an LED X-Series Driver made and sold by Aion LED, paired with a linear color tuning strip light, working together to produce millions of vibrant colors including full-spectrum white and soft pastels. The X-Series driver may integrate a 4 channel in-line dimmer with a 24V DC constant voltage type electronic power supply and an LCD display for ease of programming.

The driver may use a logarithmic pulse width modulated (PWM) dimming, which allows for smooth, flicker-free performance down to the lowest color, intensity, and power levels. The system is unique in that it can produce white light from a very warm 2150K Candle Light color to 5500K Daylight White color with only 4 colored LEDs.

The correlated color temperature (CCT) is a specification of the color appearance of the light emitted by a module or lighting source, relating its color to the color of light from a reference source when heated to a particular temperature, measured in degrees Kelvin (K). The CCT rating for a lamp is a general "warmth" or "coolness" measure of its appearance. However, opposite to the temperature scale, lamps with a CCT rating below 3200 K are usually considered "warm" sources, while those with a CCT above 4000 K are usually considered "cool" in appearance.

The white LED light source or module (W in RGBW) that is used was developed on a similar wavelength as the red in an ultra-warm hybrid between white and amber. Technically, it is white, but looks more like an amber color. The Color Rendering Index (CRI) of the white light that created with 4 colored LEDs is considered "High CRI" at 85. High CRI lighting is required for the most prestigious and high-end lighting applications. The CRI of the systems disclosed herein may be increased to 95 to ensure optimal results when mixed with red, green and blue.

In order to have repeatable results, the LEDs must have the best available batch consistency. A 2 Step MacAdam Ellipse consistency may be used, ensuring that there is a minimal or no visual variance of the LEDs from batch to batch, and even from the individual LED module within a batch. This technology allows the system to publish and adhere to third-party laboratory test results of its fixture performance including with mixed colors.

The disclosed systems and methods are capable of producing accurate color temps of "full-visual spectrum" white. Visual consistency from batch to batch is improved with industry-leading 2 step MacAdam distribution protocol employed during the manufacturing process. Individual LEDs are custom made for both fixtures to meet these criteria to ensure repeatable results that are congruent with 3rd party IES LM 79 luminaire testing set forth by the Illumination Engineering Society (IES) as a standard required for measuring performance, Quality Assurance (QA), and to qualify lighting fixtures for government subsidized rebate programs including energy efficiency programs including California's "Title 24", DesignLights Consortium (DLC), and Energy Star.

Other manufacturers of down lights have been trying to achieve full-spectrum color tuning, but may use 5-7 colored LED sources or modules. They employ additive color mixing, supplementing the red (R), green (G) and blue (B) with a warm and a cool LED. The present system approaches color mixing from a subtractive perspective by saturating the red and proprietary ultra-warm white LED and then reducing the relative green and blue to make beautiful and accurate shades of white.

This makes it possible to mix full spectrum light within a smaller package so that it can fit inside a low-profile, compact, linear LED fixture housings that are popularly used in cove lighting and other linear lighting applications.

Further, the mixed white light of this system produces is "High CRI" which refers to the "Color Rendering Index". High CRI lighting is preferred and sometimes required for many commercial and high-end residential installations. Each segment of the linear strip light creates a 6 LED circuit for each color within a 2 inch span of the linear circuit board. Each of the four colors features a chip that is used to mitigate variance in current, voltage and temperature primarily in order to protect the investment, but also to ensure flicker-free dimming to the lowest levels.

Systems, methods, and software disclosed includes mixing 4 colored LEDs using a 4 channel dynamic color/RGBW fixture to create full-spectrum white light, ranging from candle light color to daylight white. This functionality lends to circadian rhythm lighting applications that have become popular in the 21st century. Scientists and educators agree that red and blue content found within light affects the mind and body in ways that were never before understood. Mood, productivity, rest and other aspects of life have been linked to lighting and how it affects people. California's UC Davis CLTC program continues to lead the research into this phenomenon and the applicant is working as an active partner to help bring 'circadian rhythm' lighting systems to the hospitality and healthcare markets. The controller location may be known by the IP or MAC address and the circadian rhythm may be programmed to occur at corresponding time of the day at the location of the controller.

The Dynamic Tuner system can be controlled in 4 ways: iOS App, Android app, Native Keypad, and 3rd Party keypad from automation system by others.

The DTM can be configured with an optional In/Out (I/O) card that allows connectivity via serial and contact closure. This solves the problem of having two separate keypads for your lighting fixture versus other types in the home. This feature allows the system to be used with larger controls companies as a complimentary solution rather than a competitor in the lighting controls market.

FIG. 1 illustrates a lighting control environment 100 according to one example. System 100 includes fixtures 110-112, controller(s) 120-122, communication network 130, and user device 140. In FIG. 1, controllers 120-122 provide control information to the fixtures 110-112. Control information may be sent to the controllers 120-122 and/or fixtures 110-112 by a user device 140 via communication network 130.

In an example, fixtures 110-112 can include a red, green, blue, and white LED source or module. One to many fixtures may be controlled via one or more controllers 120-122. The white LED (W in RGBW) that is used was developed on a similar wavelength as the red in an ultra-warm hybrid between white and amber. Technically, it is white, but looks more like an amber color to the human eye. The communication between fixtures 110-112 and controllers 120-122 may be wired or wireless.

In this example, controller 120-122 may include a dynamic tuner module, DMX controller, driver, dimmer, and other devices and software. Controllers 120-122 may control fixtures 110-112 as described throughout this disclosure. Controller may also be included on a lighting driver, and accessed via the dynamic tuner module to a user device.

Communication network 130 can include the Internet, cellular, Wi-Fi, blue-tooth, satellite, radio frequency (RF), or any other form of wires or wireless communication network between fixtures 110-112, controllers 120-122, and user device 140, and can include cloud-type programs and devices. User device(s) 140 can smart phones, tablets, or any other device capable of sending and receiving information to the fixtures 110-112, controllers 120-122. The information may include information associated with lighting control, configuration information, and information about the fixtures 110-112, controllers 120-122, and/or the user device(s) 140, or other information.

Figure 2:
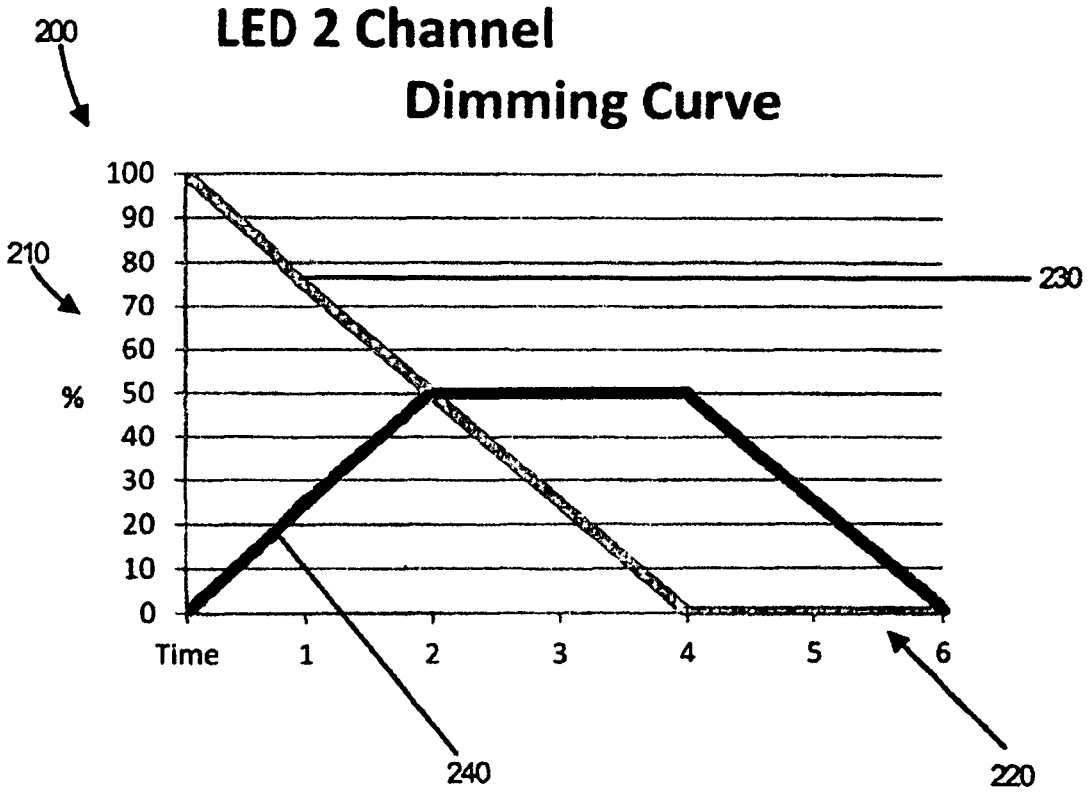
FIG. 2 illustrates a "warm" dimming curve for a two-channel LED system, according to an example.

FIG. 2 is an example 2 LED source dim graph 200 and curve, according to an example. Graph 200 includes an intensity axis 210, and a time axis 220 in seconds, showing the control of two LED modules.

The illustrated dimming pattern that allows for smooth warm-dimming effect created by two warm white LED sources or modules in one fixture. The first LED module may be capable of outputting a generally cool white light 230. The other LED module may be capable of outputting a generally ultra-warm or warmer white light 240.

This "dim curve" protocol and method was created by the applicant in order to specifically satisfy the need to efficiently emulate the perceived visual lighting performance and aesthetics of older incandescent light bulbs. When a modern LED dims, it does not change color and does not dim to a warm glow like we were used to seeing with prior technology.

Other manufacturers may attempt to cross-fade intensity between warm and cool, but the effect is not natural, or does not look natural. The solution includes never letting the total output percentage between the two LEDs exceed 100%. The cooler LED begins at 100% and dims to 50% while the warmer LED simultaneously ramps up to 50% and meets the cool LED at 50% and then dims out. The cool LED must always go down and at 50% the warm LED has peaked and then dims to off. The opposite is true when dimming up to 100% from off.

The following Table 1 includes the intensity percentage and time values for the graph in FIG. 2.

TABLE 1

| Time (sec) | Cool | Warm |
|---|---|---|
| 0 | 100 | 0 |
| 1 | 75 | 25 |
| 2 | 50 | 50 |
| 3 | 25 | 50 |
| 4 | 0 | 50 |
| 5 | 0 | 25 |
| 6 | 0 | 0 |

The applicant has also created a similar system for mixing colored LEDs to blend at various dim levels to create additional colors including millions of colors, pastels, warm white, neutral white, cool white from 2150K to 5500K. A unique aspect of the LED technology is its ability to save its complex proprietary dimming curves and programming to a device as well as to a power supply. Various additional functionality may be stored at a driver or the DTM to permit LED sources to have the additional functionality as disclosed herein. The system may be triggered by a keypad or scheduler from a third party button press for repeatable results.

Current LED dimming may vary and will not mimic an incandescent light. The curve in FIG. 2 allows for the warm dimming effect to occur with only two LED sources or modules, which is imperative for linear applications that required tight pitch (spacing between LEDs) for uniform diffusion. In the curve in FIG. 2, the cool LED source at max brightness or intensity begins to descend while the warm LED source intensity is increased from zero. Rather than crossing over in the middle and trading, the curve of FIG. 2 dictates that the intensity of the warm LED stops at 50% and returns to zero percent.

Another breakthrough is that a 4 channel dynamic color/RGBW fixture system can create very nice white light ranging from candle light white to daylight white, in addition to millions of colors and pastels. This enhanced functionality allows for the reproduction of daylight indoors without windows as well as simulation of the sun thought the day for circadian rhythm applications.

Further, the new 4 channel dynamic color/RGBW fixture system can create a similar warm-dimming effect to the 2 Channel Dynamic Cool/Warm 'Dim to Glow' product, but instead of using a warm white and cool white LED, it uses a red, green, blue and a warm white LED that contains proprietary specifications and electrical characteristics to create a high rendering (90+CRI) white that is amplified by the mixed white light created by mixing Red, Green and Blue together. The result is a full-spectrum tuning system that can also do warm dimming and can be triggered easily by most 3rd party keypads and controls schedulers.

Figure 3:
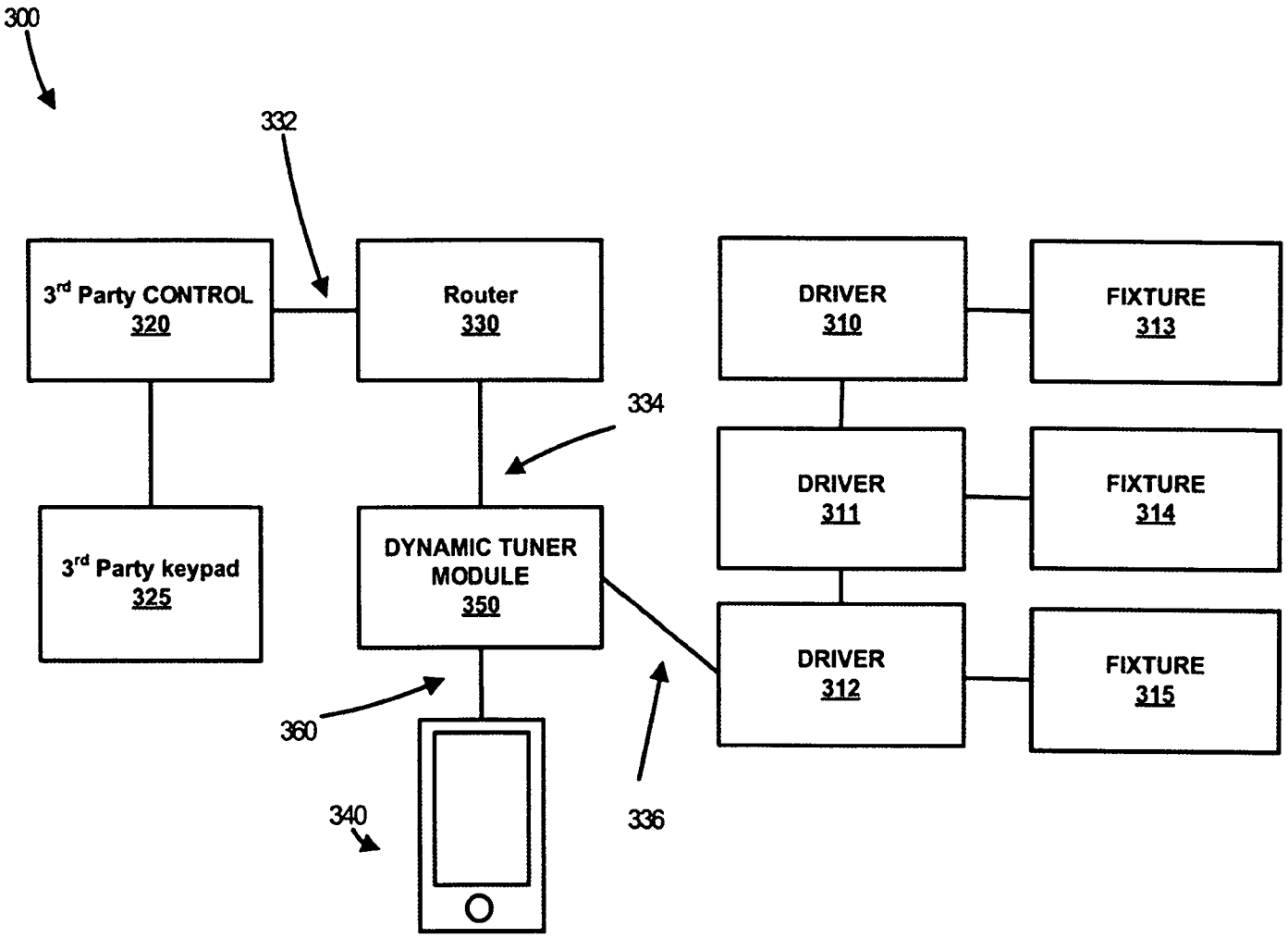
FIG. 3 illustrates a system controller environment according to one example.

FIG. 3 is a lighting system controller environment 300, according to one example. System 300 includes drivers 310-312, fixtures 313-315 controller(s) 320, router 330, and user device 340. System 300 may also include an input device 325, which is configured to communicate with control 320, either wired or wirelessly, to provide information to send native or segmented lighting control information to drivers 310-312 to control lighting fixtures 313-315 attached thereto.

Control 320 may send information to router 330 via communication link 332, which may be wired or wireless. The information sent by control 320 may be user datagram protocol (UDP), or other format. Router 330 may send information to or through DTM 350 via communication link 334, which may be wired or wireless. DTM 350 may send information to drivers 310-312 via communication link 336, which may be wired or wireless. Drivers 310-312 may be configured to communicate between themselves or directly to the DTM 350.

DTM 350 may communicate with user device 340 to receive non-native lighting control information via script commands or other protocol, system, or method. An application on user device 340 may be configured to intercept or otherwise receive the native lighting control information being sent from control 320 to drivers 310-312 and modify, or augment it via the DTM 350. DTM 350 may open a tel-net session, or other communication systems or methods, with the control 320 for communication.

Augmented lighting control information may them be sent from the DTM 350 to the drivers 310-312 to provide control of fixtures 313-315. This may add functionality not included in the control 320, and may give a user an easier interface to use to control drivers 310-312 and fixtures 313-315 coupled thereto.

In an example, a user may input lighting control information at input device 325, which is sent to control 320. Control 320 creates coded information to control the lighting fixtures in a first or native format or language, via drivers 310-312. That information in a first language is sent via communication links and router 330 to DTM 350.

The application on the user device 340 communicates with the DTM 350, and takes the information in the first language and receives non-native information from the user device 340. The DTM 350 may then combine the native and non-native information to create augmented lighting control information 336, which is sent to the drivers 310-312 to control fixtures 313-315. The segmented lighting control information may provide additional functionality for controlling the fixtures 313-315, than by the native controls.

Furthermore, additional functionality may be implemented and the resulting information and added information may be sent to the fixtures via the drivers 310-312. This may provide addition functionality, such as warm dim and better color tuning and control that is available via control 320. If no additional functionality is desired, the native information may be passed directly on to the drivers 310-312.

In another embodiment, the application on the user device 340 communicates with the DTM 350, and takes the native information and adds/changes/augments it to create different control information (augmented) to change the behavior of the fixture(s).

The DTM 350 may be added to an existing third party system to enhance the functionality of the lighting control, as well as give a user an application on a user device 340 to more easily control the lighting fixtures. The DTM 350 may add functionality without have to hardwire more control pads or install an entire new control system.

Native lighting control information may be in DMX format, and may include on, off, and brightness level. The functionality of the app on the user device 340, and the DTM 350 may include additional functionality, including RGBW control to mix the output of the fixtures to produce warmer or better white light. Furthermore, the fixtures 313-315 may include only two colors, and the user device 340 and the DTM 350 may provide a warm dim output, which emulates dimming of an incandescent fixture.

One unique feature of the dynamic tuner module 350 is how it interacts with an iOS App on the user device 410, 340, 140. The DTM 350 arrives without loaded software and the iOS app allows the installer to configure the DTM 350 by loading the appropriate software based on fixture type and technology (2 channel Dim to Glow or 4 Channel RGBW+). Once loaded, the installer further configures the system by selecting which of the App's 4+ features to populate onto the 6 available keypad and virtual buttons (plus 2 for UP/DOWN), among other functionality: Color, Cycle, Dim to Glow, and Sundial.

The 'Color' feature allows users to select colors from a virtual color dial as well as shades of white from a linear gradient on the GUI. Essentially, users can select colors, edit and save them to memory for use with the 'Cycle' feature or for special themes, occasions, moods, etc. 'Cycle' provides the ability to rotate through selected and customized colors at user-defined rates and fade times.

'Dim to Glow' feature allows the user to populate a button after designating a maximum white level (CCT) and then to populate a button and when dimmed with the DOWN ARROW, the light color temperature incrementally warms to a glow as the light dims down to 0.1%.

'Sundial' is a scheduler with Astrological Time Clock features and global positioning. Sundial can emulate daylight by use of an atomic clock via the app on the user device 340. The IP address of the user device 340 provides the latitude and longitude of a given location to accurately determine sunrise and sunset times that vary throughout the year based on the position of the earth in relation to the sun. Sundial allows users to place. Color, Cycle and Dim to Glow events in time on a 24 hour basis, 7 days a week. Sundial™ can schedule lights to change color, intensity and temperature on a 24 hour basis, 7 days a week.

The LED Dynamic Tuner iOS App (with Sundial) will allows installers the power to easily and efficiently commission the system (configure buttons, colors and other parameters), to perform multi-channel color tuning operations such as "warm dim", without needing to understand nor implement complex DMX programming. Installers and now even end users can set up complex operations including appropriation of button functionality, setting up multiple dim curves that work in concert to achieve various colors, color temperatures of whites at dim levels between 0.1 and 100%, color cycles, and daylight emulation.

It is a known problem that DMX lighting requires an expert to be hired in addition to the electrician in order to program the system. Many times the programmer is sent by the equipment manufacturer to remote locations world-wide at the expense of the end user. The Dynamic Tuner App eliminates all of that, saving all parties involved time and money. Additional functionality may be sent to the DTM 350 from the user device 340 and stored at the DTM 350. Using the app on the user device 340, an unskilled user may relatively easily select and assign various functionality to the button presses from the existing system. No additional programming or programmer is needed.

Some popular high-end control systems such as Lutron Electronics' 'Radio RA' type dimming system do not include a DMX interface, making it impossible to interface with multi-channel lighting at all. The disclosed system provides a solution by employing a unique method of communicating with 3rd party keypad (integration) via the Dynamic Tuner iOS App on the user device 340.

The hardware part: "Dynamic Tuner Module" 350 ships un-loaded with software, then the installer (or user) uploads the appropriate functionality based on the application's requirements. The installer can set up a 1:1 correlation between the 3rd party keypad's buttons and the Dynamic Tuner iOS App's virtual buttons. By doing, so, all that needs to be done on the third party side is to send button press on/off data via contact closure relay, RS-232 (Serial cable) or TCP/IP (Ethernet); that the Dynamic Tuner iOS app translates into complex operations via its proprietary native code and downloads to the Dynamic Tuner Module during setup. Other manufacturers may use their own keypads and dimmers with their devices. Aion LED prefers its users to select their favorite or existing major brand dimmer that is compatible with the DTM.

Figure 6:
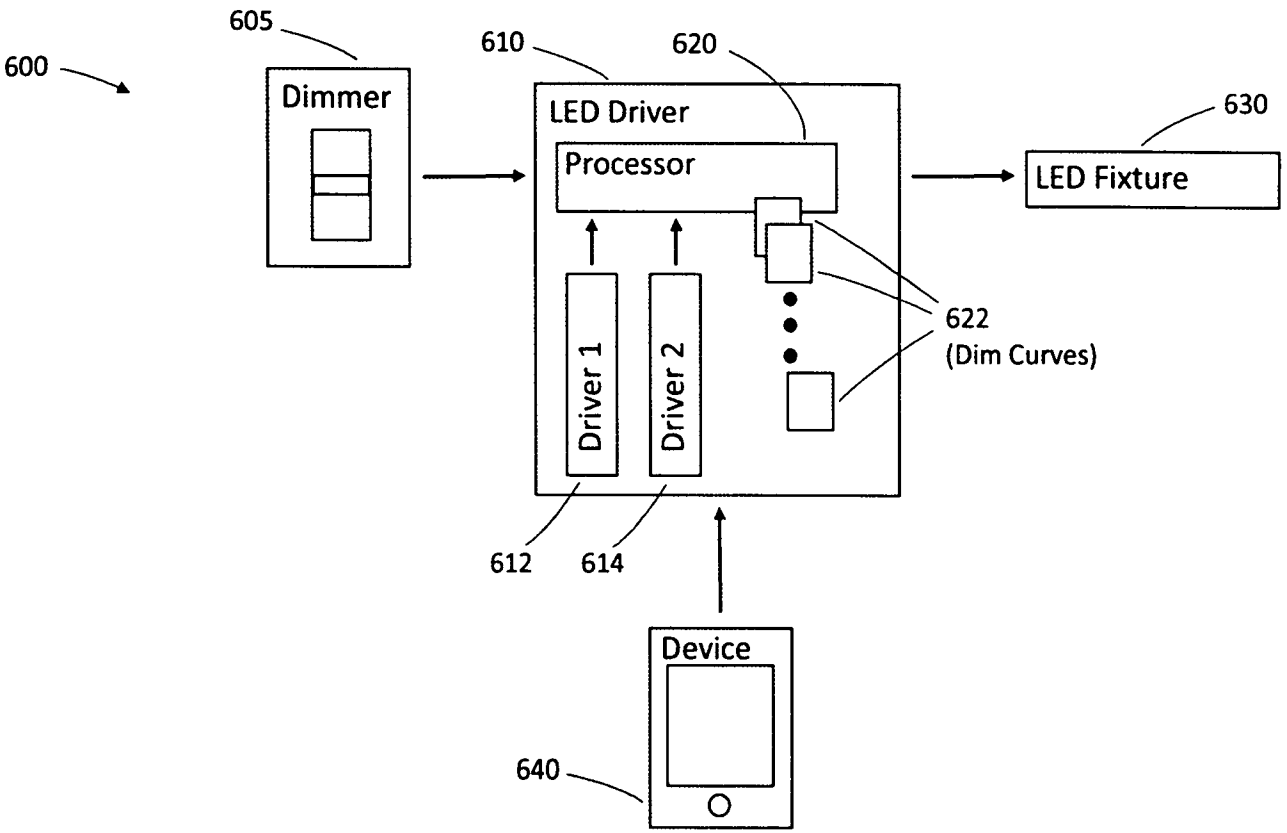
FIG. 6 illustrates a system controller environment, according to one example.

In another example, the driver 310-312 may be a warm-dimming LED driver, which may provide a simpler solution to dimming LED lights to a warm glow without the need for a more complex DMX system or tuner. This example is illustrated by system 600 of FIG. 6.

The driver 610 of system 600 may simplify and automate the process of creating the warm-dimming effect by storing multi-channel dim curves 622 on a microprocessor 620 and/or memory that can store the dim curves 622 and can be activated by a standard wall box dimmer 605. The microprocessor 620 may be a part of the DTM or the driver 610. This driver 610 simplifies wiring, installation and saves cost and eliminates the DMX and DMX drivers required with the DTM solution.

This may also allow a device 640 to communicate directly with the driver 610 and provide the functionality to receive the binary communication from the third party control and change and or augment the communication to change the control information and thereby change the functionality of the driver 610.

As discussed above with respect to FIG. 2, a smooth warm-dimming effect may be created by two warm white LED sources or modules in one LED fixture 630. A first LED driver 612 may be capable of outputting a generally cool white light, and a second LED driver 614 may be capable of outputting a generally ultra-warm or warmer white light.

The Dynamic Tuner Module 350 and iOS app ("the app") on the user device 340 may first discover available Dynamic Tuner Modules 350 by broadcasting a Multicast Ping to 239.255.204.2 on the local network, to which each Dynamic Tuner Module 350 responds with its IP address and other basic information. In the event that the Dynamic Tuner Module 350 is not responding or unreachable, the server-related information can also be entered in manually.

Once the correct information has been supplied and the app is able to connect to the Dynamic Tuner Module 350 by issuing a test command, the app begins by initializing basic commands to establish expected security needs (password) and configuration needs. The app then writes a collection of universal commands that can be later used by individual presets that manage stored variables in memory. The goal of initializing these universal commands is to simplify and shorten the complexity and therefore save time of individual button presets that the user creates.

From the app, simple commands are issued over the network as short strings understandable by Dynamic Tuner Module 350 in the form of native or other script commands to activate saved button presets that depend on the universal commands.

The app allows for network triggers to be created on the Dynamic Tuner Module 350 so that it can listen for network traffic on specific ports and/or IP addresses with specific strings. Depending on the received string, it can perform simple commands, such as activating a specified preset. Network triggers are particularly useful so that 3rd party devices can issue commands that Dynamic Tuner Module 350 responds to in the same way that it responds to the app's simple commands.

On setup completion, the app's home screen is displayed on the user device 350 with buttons that mirror the layout of button wall panels 325 used in similar systems. Each button can be edited to write a custom preset functionality to the Dynamic Tuner Module 350 from the app that can be operated later without the use of the app. Once the preset is defined and saved to the Dynamic Tuner Module 350, only simple commands are needed from the app, wall panel, or network trigger to activate the complex logic that manages button presets.

All of the independent and integrated functionality is created from within the app so that it can configure Dynamic Tuner Module 350 to listen to 3rd party commands, manage dimming, dim level recall, active sundial states, active color, and cycle speeds behind the various preset modes.

The system includes software interface as well as the LED systems and associated dimming levels and methods utilized to create full-spectrum color-tuning lighting systems that can reproduce accurate, high quality lighting.

Figure 4:
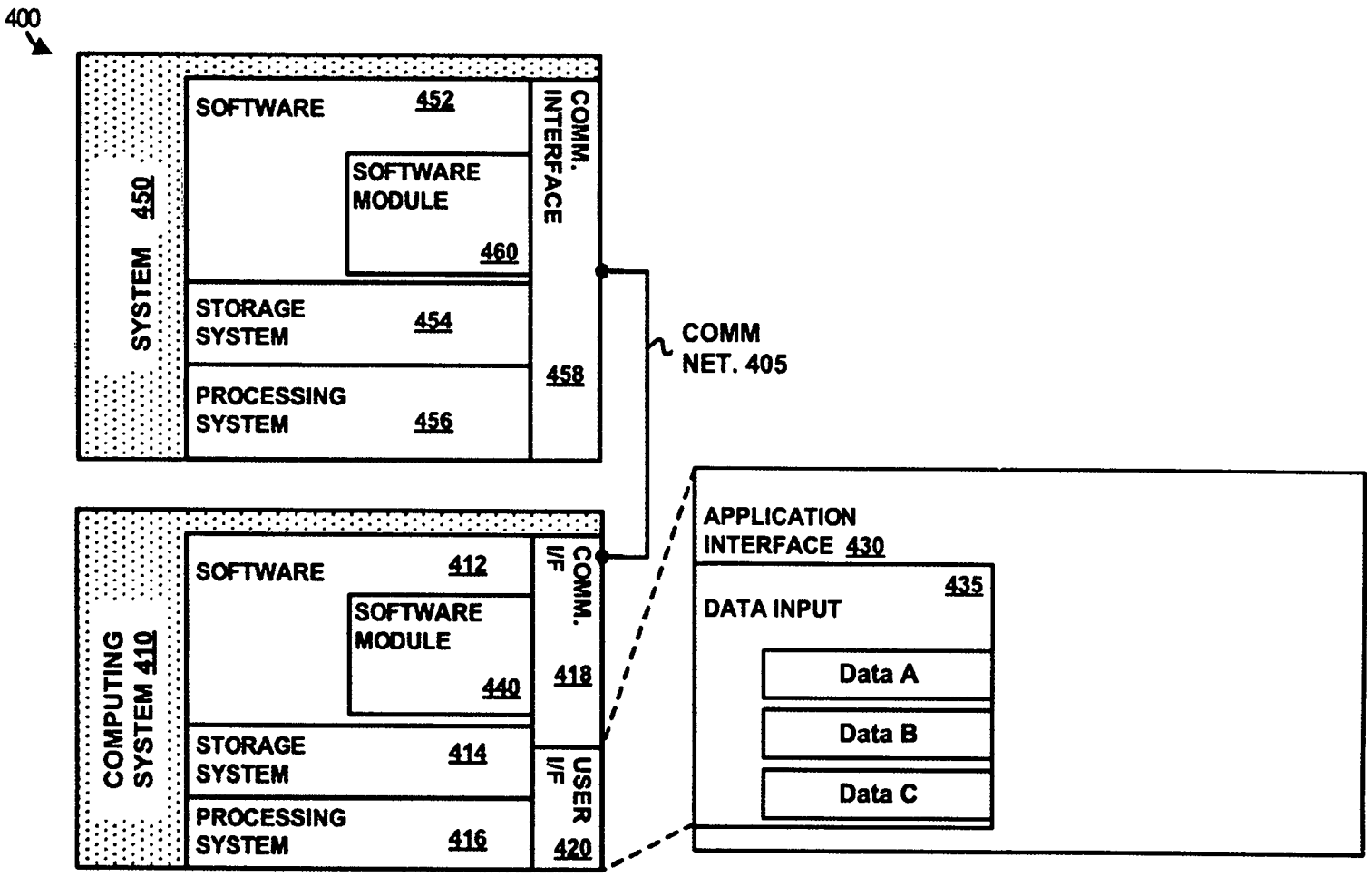
FIG. 4 illustrates a system controller environment, according to one example.

FIG. 4 illustrates a monitoring computing environment 400 according to one example. In an example, computing environment 400 includes computing system 410 and system 450. Computing system 410, in the present example, corresponds to user device 140, and system 450 corresponds generally to controllers 120-122 and 320.

Computing system 410 can include any smart phone, tablet computer, laptop computer, computing device, or other device capable of reading, and/or recording data about systems, devices, locations, and/or equipment, etc. System 450 can include any controller, module, software, or other device capable of controlling fixtures 110-112.

In FIG. 4, computing system 410 includes processing system 416, storage system 414, software 412, communication interface 418, and user interface 420. Processing system 416 loads and executes software 412 from storage system 414, including software module 440. When executed by computing system 410, software module 440 directs processing system 416 to accomplish all or portions of the methods and other controls described in this disclosure. It should be understood that one or more modules could provide the same operation.

Additionally, computing system 410 includes communication interface 418 that can be further configured to transmit the information to system 450 using communication network 405. Communication network 405 could include the Internet, cellular network, satellite network, RF communication, blue-tooth type communication or any other form of wired or wireless communication network capable of facilitating communication between systems 410, 450.

Referring still to FIG. 4, processing system 416 can comprise a microprocessor and other circuitry that retrieves and executes software 412 from storage system 414. Processing system 416 can be implemented within a single processing device but can also be distributed across multiple processing devices or sub-systems that cooperate in executing program instructions. Examples of processing system 416 include general purpose central processing units, application specific processors, and logic devices, as well as any other type of processing device, combinations of processing devices, or variations thereof.

Storage system 414 can comprise any storage media readable by processing system 416, and capable of storing software 412. Storage system 414 can include volatile and nonvolatile, removable and non-removable media implemented in any method or technology for storage of information, such as computer readable instructions, data structures, program modules, or other data. Storage system 414 can be implemented as a single storage device but may also be implemented across multiple storage devices or subsystems. Storage system 414 can comprise additional elements, such as a controller, capable of communicating with processing system 416.

Examples of storage media include random access memory, read only memory, magnetic disks, optical disks, flash memory, virtual memory, and non-virtual memory, magnetic cassettes, magnetic tape, magnetic disk storage or other magnetic storage devices, or any other medium which can be used to store the desired information and that may be accessed by an instruction execution system, as well as any combination or variation thereof, or any other type of storage media. In some implementations, the storage media can be a non-transitory storage media. In some implementations, at least a portion of the storage media may be transitory. It should be understood that in no case is the storage media a propagated signal.

User interface 420 can include a mouse, keypad, a keyboard, a camera, a Barcode scanner, a QR scanner, a voice input device, a touch input device for receiving a gesture from a user, a motion input device for detecting non-touch gestures and other motions by a user, and other comparable input devices and associated processing elements capable of receiving user input from a user. These input devices can be used for indicating lighting control and other information. Output devices such as a graphical display, speakers, printer, haptic devices, and other types of output devices may also be included in user interface 420. The aforementioned user input and output devices are well known in the art and need not be discussed at length here.

Application interface 430 can include data input section. In one example, data input 435 can be used to collect/input information regarding lighting control from a user.

System 450 may include processing system 456, storage system 454, software 452, and communication interface 458. Processing system 456 loads and executes software 452 from storage system 454, including software module 460. When executed by computing system 450, software module 460 directs processing system 410 to store and manage the data from computing system 410 and other similar computing systems and keypads and other input devices.

Although system 450 includes one software module in the present example, it should be understood that one or more modules could provide the same operation.

Additionally, system 450 includes communication interface 458 that can be configured to receive the data from computing system 410 using communication network 405. Furthermore, communication interface 418, 458 is capable of sending and receiving information to and from fixtures capable of transmitting and receiving information wirelessly, such as via a Bluetooth-type communication.

Referring still to FIG. 4, processing system 456 can comprise a microprocessor and other circuitry that retrieves and executes software 452 from storage system 454. Processing system 456 can be implemented within a single processing device but can also be distributed across multiple processing devices or sub-systems that cooperate in executing program instructions. Examples of processing system 456 include general purpose central processing units, application specific processors, and logic devices, as well as any other type of processing device, combinations of processing devices, or variations thereof.

Storage system 454 can comprise any storage media readable by processing system 456 and capable of storing software 452 and data from computing system 410. Data from computing system 410 may be stored in a many forms. Storage system 454 can include volatile and nonvolatile, removable and non-removable media implemented in any method or technology for storage of information, such as computer readable instructions, data structures, program modules, or other data. Storage system 454 can be implemented as a single storage device but may also be implemented across multiple storage devices or sub-systems. Storage system 454 can comprise additional elements, such as a controller, capable of communicating with processing system 456.

Examples of storage media include random access memory, read only memory, magnetic disks, optical disks, flash memory, virtual memory, and non-virtual memory, magnetic cassettes, magnetic tape, magnetic disk storage or other magnetic storage devices, or any other medium which can be used to store the desired information and that may be accessed by an instruction execution system, as well as any combination or variation thereof, or any other type of storage media. In some implementations, the storage media can be a non-transitory storage media. In some implementations, at least a portion of the storage media may be transitory. It should be understood that in no case is the storage media a propagated signal.

In some examples, system 450 could include a user interface, such as a keypad or other input device or system. The user interface can include a mouse, keypad, a keyboard, a voice input device, a touch input device for receiving a gesture from a user, a motion input device for detecting non-touch gestures and other motions by a user, and other comparable input devices and associated processing elements capable of receiving user input from a user.

It should be understood that although computing system 450 is shown as one system, the system can comprise one or more systems to store and manage received data.

Figure 5:
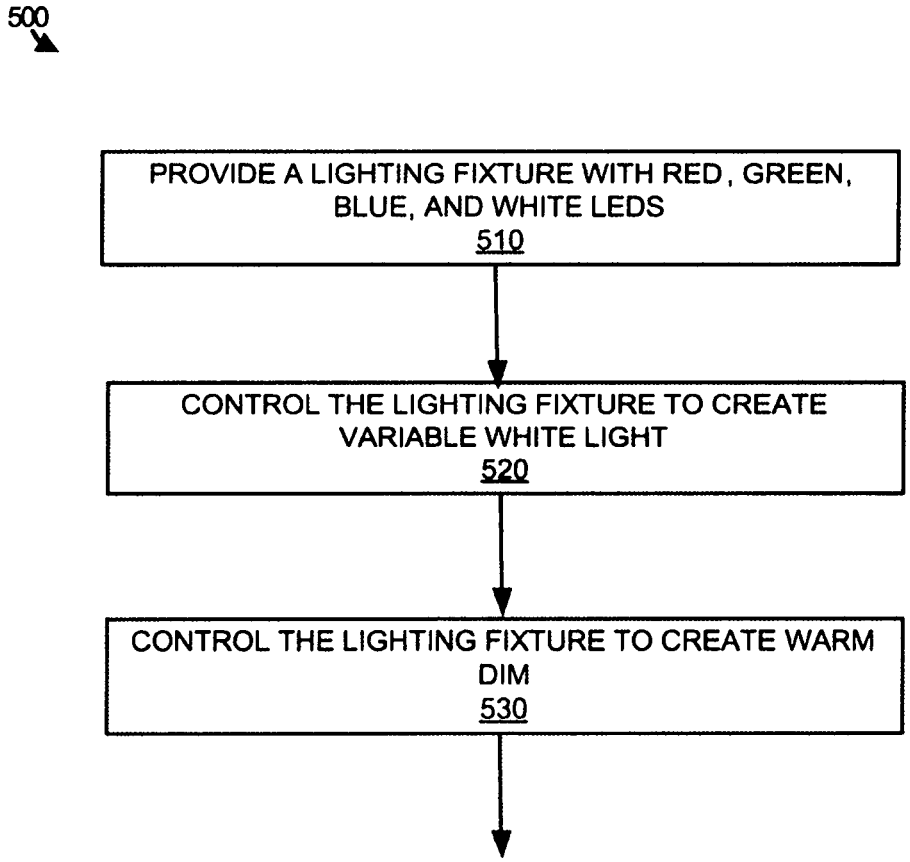
FIG. 5 illustrates a method according to one example.

FIG. 5 illustrates a method 500 for controlling lighting systems, devices, and/or software, etc. The method begins with providing one or more lighting fixtures with red, blue, green, and white producing LEDs (510).

A controller may be used to control the fixtures to create or provide variable white light (520). Control information may be provided by a user device 140. This user device may include a smart phone, tablet computer, monitoring device attached to a vehicle, or any other device configured to send information to controllers or fixtures or other equipment, etc.

The variable white light may be produced using 4 channel dynamic color/RGBW fixture system, by saturating the red and white LED and then reducing the relative green and blue to make beautiful and accurate shades of white.

Method 500 may also include controlling a lighting fixture to create a warm dim output 250. In one embodiment the desired output is a generally a warm white light. In other embodiments the desired output is a warm dim effect, as described in FIG. 5.

Although the example method described as controlling, a 4-channel dynamic color/RGBW fixture, it may be used to control other types of lighting fixtures. Additionally, it should be understood that the order of events in method 500 could be rearranged and/or accomplished concurrently.

The included descriptions and figures depict specific implementations to teach those skilled in the art how to make and use the best mode. For the purpose of teaching inventive principles, some conventional aspects have been simplified or omitted. Those skilled in the art will appreciate variations from these implementations that fall within the scope of the invention. Those skilled in the art will also appreciate that the features described above can be combined in various ways to form multiple implementations. As a result, the invention is not limited to the specific implementations described above, but only by the claims and their equivalents.

What is claimed is:

1. A lighting system comprising:

a first diode light source that emits light of a first characteristic;

a second diode light source that emits light of a second characteristic; and a controller operating to modify the first diode light source and the second diode light source by selectively:

decreasing the first diode light source from a first percent output to a second percent output, which is lower than the first percent output, while increasing the second diode light source from a first percent output to a second percent output, which corresponds to the second percent output of the first diode light source, varying the first diode light source from the second percent output to a third percent output, which is lower than the second percent output, while maintaining the second diode light source generally at the second percent output thereof, and varying the second diode light source from the second percent output to a third percent output, which is lower than the second percent output of the second diode light source, while maintaining the first diode light source generally at the third percent output thereof; wherein:

a rate of change associated with decreasing the output of the first diode light source from the first percent output to the second percent output is opposite to a rate of change associated with increasing the output of the second diode light source from the first percent output to the second percent output, and a rate of change associated with decreasing the output of the first diode light source from the second percent output to the third percent output is equal to a rate of change associated with decreasing the output of the second diode light source from the second percent output to the third percent output.

2. The system of claim 1, wherein the light of a first characteristic is cool white light and the light of a second characteristic is ultra warm white light or warm white light.

3. The system of claim 1, wherein the controller operating comprises modifying the first diode light source and the second diode light source by at least two of selectively:

decreasing the first diode light source from a first percent output to a second percent output, which is lower than the first percent output, while increasing the second diode light source from a first percent output to a second percent output, which corresponds to the second percent output of the first diode light source, varying the first diode light source from the second percent output to a third percent output, which is lower than the second percent output, while maintaining the second diode light source generally at the second percent output thereof, and varying the second diode light source from the second percent output to a third percent output, which is lower than the second percent output of the second diode light source, while maintaining the first diode light source generally at the third percent output thereof.

4. The system of claim 1, wherein the controller operating comprises modifying the first diode light source and the second diode light source by:

in a first period of time, decreasing the first diode light source from a first percent output to a second percent output, which is lower than the first percent output, while increasing the second diode light source from a first percent output to a second percent output, which corresponds to the second percent output of the first diode light source, wherein at the end of the first period of time the second percent output of the first diode light source and the second percent output of the second diode light source are equal, in a second period of time occurring after the first period of time, varying the first diode light source from the second percent output to a third percent output, which is lower than the second percent output, while maintaining the second diode light source generally at the second percent output thereof, and in a third period of time occurring after the second period of time, varying the second diode light source from the second percent output to a third percent output, which is lower than the second percent output of the second diode light source, while maintaining the first diode light source generally at the third percent output thereof, wherein at the end of the third period of time the third percent output of the first diode light source and the third percent output of the third diode light source are equal.

5. The system of claim 4, wherein the length of the first period of time, the second period of time, and the third period of time are substantially equal.

6. The system of claim 4, wherein the second percent output of the second diode light source never exceeds 50 percent.

7. The system of claim 4, wherein:

the first percent output of the first diode light source is about 100 percent;

the second percent output of the first diode light source is about 50 percent;

the third percent output of the first diode light source is about 0 percent;

the first percent output of the second diode light source is about 0 percent;

the second percent output of the second diode light source is about 50 percent; and the third percent output of the second diode light source is about 0 percent.

8. The system of claim 7, wherein the end of the first period of time is about 2 seconds, the end of the second period of time is about 4 seconds, and the end of the third period of time is about 6 seconds.

9. The system of claim 7, wherein the first diode light source outputs light at about 3000 K, and the second diode light source outputs light at about 2150 K, wherein the light emitted from the LED lighting fixture has an aggregate temperature of:

about 3000 K at the beginning of the first period of time, about 2575 K at the beginning of the second period of time, about 1075 K at the beginning of third period of time, and about 0 K at the end of the third period of time.

10. The system of claim 1, wherein the first diode light source outputs light at a first temperature, and the second diode light source outputs light at a second temperature that is different from the first temperature.

11. The system of claim 10, wherein the first temperature is about 3000 K and the second temperature is about 2150 K.

12. The system of claim 1, wherein the first diode light source is comprised of a combination of a blue light source and a green light source, and the second diode light source is comprised of a combination of a red light source and a white light source.

13. The system of claim 1, wherein the controller is further configured to control both the first diode light source and the second diode light source by way of a multi-channel dim curve, the multi-channel dim curve comprising a set of control instructions for each of the first diode light source and the second diode light source.

14. The system of claim 13, wherein the multi-channel dim curve is a set of multi-channel dim curves.

15. The system of claim 14, wherein the set of multi-channel dim curves are stored in a memory of the controller.

16. An LED lighting system comprising:

a first diode light source that emits light of a first characteristic;

a second diode light source that emits light of a second characteristic;

a controller operating to modify the first diode light source and the second diode light source by selectively:

decreasing the first diode light source from a first percent output to a second percent output, which is lower than the first percent output, while increasing the second diode light source from a first percent output to a second percent output, which corresponds to the second percent output of the first diode light source, varying the first diode light source from the second percent output to a third percent output, which is lower than the second percent output, while maintaining the second diode light source generally at the second percent output thereof, and varying the second diode light source from the second percent output to a third percent output, which is lower than the second percent output of the second diode light source, while maintaining the first diode light source generally at the third percent output thereof; and wherein:

the first diode light source outputs light at a first temperature, and the second diode light source outputs light at a second temperature that is different from the first temperature;

a rate of change associated with decreasing the output of the first diode light source from the first percent output to the second percent output is opposite to a rate of change associated with increasing the output of the second diode light source from the first percent output to the second percent output; and a rate of change associated with decreasing the output of the first diode light source from the second percent output to the third percent output is equal to a rate of change associated with decreasing the output of the second diode light source from the second percent output to the third percent output.

17. The system of claim 16, wherein the light of a first characteristic is cool white light and the light of a second characteristic is ultra warm white light or warm white light.

18. The system of claim 16, wherein the first temperature is about 3000 K and the second temperature is about 2150 K.

19. The system of claim 16, wherein:

the controller is further configured to control both the first diode light source and the second diode light source by way of a multi-channel dim curve, the multi-channel dim curve comprising a set of control instructions for each of the first diode light source and the second diode light source; and the multi-channel dim curve is a set of multi-channel dim curves.

20. A diode lighting system comprising:

a first diode light source that emits light of a first characteristic;

a second diode light source that emits light of a second characteristic; and an LED driver comprising a processor, the processor storing a set of multi-channel dim curves, the set of multi-channel dim curves comprising a set of control instructions for each of the first diode light source and the second diode light source; wherein the set of control instructions for each of the first diode light source and the second diode light source is selectable and controls the first diode light source and the second diode light source;

the set of multi-channel dim curves comprise a dim curve defined by:

decreasing the first diode light source from a first percent output to a second percent output, which is lower than the first percent output, while increasing the second diode light source from a first percent output to a second percent output, which corresponds to the second percent output of the first diode light source, varying the first diode light source from the second percent output to a third percent output, which is lower than the second percent output, while maintaining the second diode light source generally at the second percent output thereof, and varying the second diode light source from the second percent output to a third percent output, which is lower than the second percent output of the second diode light source, while maintaining the first diode light source generally at the third percent output thereof.

* * * * *